United States Patent [19]

Hammelmann

[11] Patent Number: 5,060,863

[45] Date of Patent: Oct. 29, 1991

[54] NOZZLE HEAD

[76] Inventor: Paul Hammelmann, Zum Sundern 17, 4740 Oelde 1, Fed. Rep. of Germany

[21] Appl. No.: 469,955

[22] Filed: Jan. 25, 1990

[30] Foreign Application Priority Data

Jan. 25, 1989 [DE] Fed. Rep. of Germany ..... 3902135

[51] Int. Cl.[5] ..... B05B 3/06; B05B 1/14

[52] U.S. Cl. ..... 239/252; 239/259; 239/251

[58] Field of Search ..... 239/251, 252, 261, 259

[56] References Cited

U.S. PATENT DOCUMENTS

| | | | |
|---|---|---|---|
| 4,747,544 | 5/1988 | Kränzle | 239/252 |
| 4,821,961 | 4/1989 | Shook | 239/261 |
| 4,923,120 | 5/1990 | Hammelmann | 239/252 |

*Primary Examiner*—Andres Kashnikow

*Assistant Examiner*—Karen B. Merritt

*Attorney, Agent, or Firm*—Michael J. Striker

[57] ABSTRACT

A nozzle head comprises a plurality of nozzles, a nozzle carrier rotatable about an axis and driveable by a reaction of a pressurized water discharged from the nozzles, a stationary housing, a hollow shaft extending through the housing and having a central passage, a sleeve extending through the central passage of the hollow shaft, the sleeve forming a supply conduit and extending to the region of the nozzle carrier. The sleeve has a free end which is closed and a transverse opening which opens into the supply conduit, the nozzle carrier having a plurality of passages extending from the transverse opening to the nozzles for supplying pressurized water, and the nozzles being arranged so that water jets discharged from the nozzles are interrupted into edge regions of a jet curve parallel to a displacement direction of the nozzle head relative to an object.

17 Claims, 6 Drawing Sheets

NOZZLE HEAD

BACKGROUND OF THE INVENTION

The present invention relates generally to nozzle heads. More particularly, it relates to a nozzle head with a plurality of nozzles, a nozzle carrier rotatable about an axis and driveable by a reaction of pressurized water discharged from the nozzles, a brake for braking a rotary movement of the nozzle carrier, a stationary housing provided with a pressurized water connection, and a hollow shaft extending from the pressurized water connection and having a central passage which accommodates a sleeve, as well as a labyrinth gap seal provided between the sleeve and a limiting wall of the central passage.

Nozzle heads of the above mentioned general type are known in the art. One of such nozzle heads is disclosed for example in the U.S. patent application Ser. No. 07/390,187.

Such a nozzle head utilizes the principle of reaction driven rotatable tools and includes a reaction impeller. Their rotary speed is limited by hydraulic, mechanical or other eddy current brakes. The jets which discharge from the rotatable nozzles form circular striking lines on the object to be treated. They are compressed at the right side and the left side of the displacement direction of the tool very intensely and thereby a substantially strong degradation power is produced. Due to the displacement of the tool, strongly degraded regions are produced left and right of the straight tangents in the displacement direction.

SUMMARY OF THE INVENTION

Accordingly, it is an object of the present invention to provide a nozzle head in which the energy can be used in the above mentioned degrading regions for reinforcing the displacement.

In keeping with these objects and with others which will become apparent hereinafter, one feature of the present invention resides, briefly stated, in a nozzle head in which the sleeve which forms the supply conduit extends to the nozzle carrier, its free end is closed, and at least one transverse opening which opens into the supply conduit is provided, and the transverse opening is connected with the jet nozzles through passages extending in the nozzle carrier from the transverse opening. The water jets continuously discharging from the injection nozzles in known tools are interrupted in accordance with the present invention in the strongly degrading edge regions of the jet arc.

During a jet interruption of 70° in an edge region, for a full circle of 360° it is double 70°. The pump output can in this case be produced from the remaining double 110°. Thereby an increase of the energy density in the displacement direction is $$\frac{360 \times 100}{220} = 164.$$

This corresponds to an increase of the energy density by 64%, while the remaining effective working width is reduced only by 18%. A further output increasing effect is performed by the jet interruption, so that an improvement of the total action constitutes over 50%.

In accordance with another feature of the present invention, the sleeve has only one transverse opening which extends over its whole cross-section, the nozzle carrier has four injection nozzles and four associated passages for supplying pressurized water to the nozzles, and the central axes of the passages intersect with a central axis of the supply conduit of the sleeve in a single point.

In accordance with further features of the present invention, the transverse opening can have a diameter which is smaller than the inner diameter of the passages leading to the nozzles or greater than the inner diameter.

The nozzle carrier can be formed as a multi-cornered structure and provided with cylindrical recesses for receiving the ends of cylindrical pipes of an angular piece. The vertical legs of the angular piece support the injection nozzles. The angular piece is provided with the above mentioned passages for supplying pressurized water to the nozzles and is rotatable in stepless manner and arrestable relative to the nozzle carrier.

The passage for supplying pressurized water from the transverse opening to the nozzles can be limited by bushings. The bushings can have opposite ends abutting against the hollow shaft and the cylindrical pipes of the angular piece.

In accordance with a still further feature of the present invention, a ring groove extending over a whole periphery can be provided between the nozzle carrier and the cylindrical pipe of the angular piece, and a sealing and anchoring ring can be accomodated in the annular groove. This ring can extend into angular ring grooves of the nozzle carrier and a mounting block which surrounds the pipes and is connected with the nozzle carrier.

The nozzle carrier can have an opening extending over its whole height and accomodating a free end of the hollow shaft. The hollow shaft can be welded to the nozzle carrier. The hollow shaft can be surrounded over its whole length with a stationary sleeve.

The transverse opening of the sleeve can be arranged at a distance from the closed end of the sleeve. The hollow shaft can have the central passage extending over its whole length and accommodating the sleeve over the whole length, while the sleeve can be connected with a head piece in a housing body. The hollow shaft and the nozzle carrier can be formed of one piece with one another. Finally, a protective ring can surround the nozzle carrier at a free end of the housing body.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
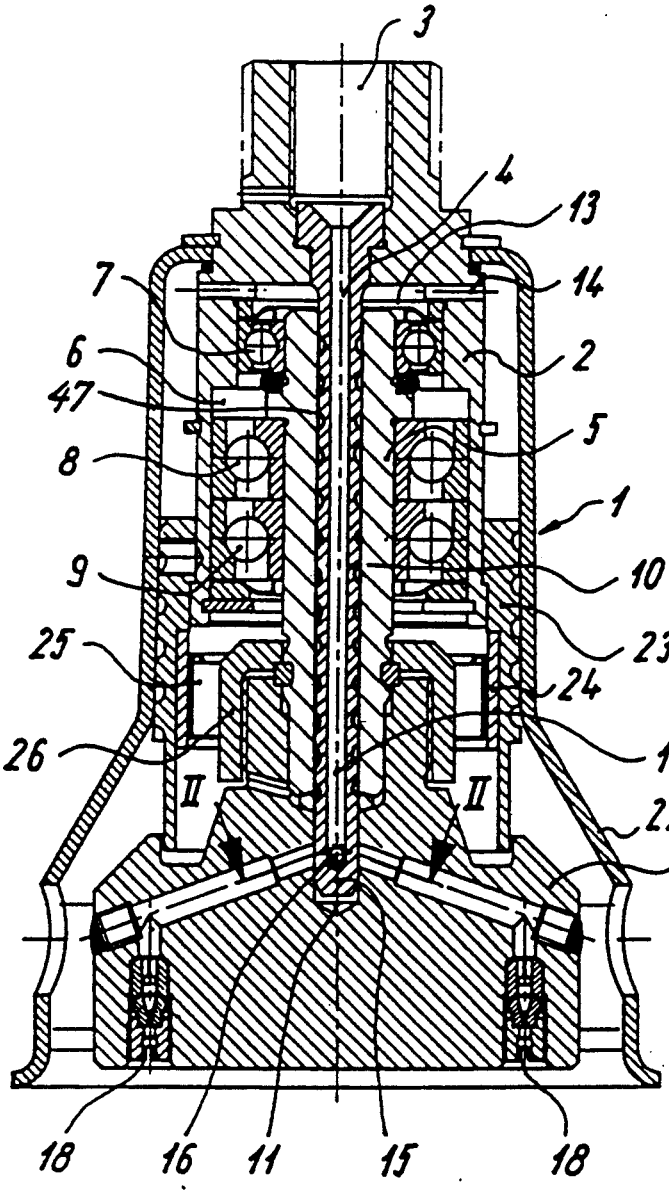
FIG. 1 is a view showing a nozzle head provided with a nozzle carrier which is driven by pressurized water, in a vertical section.

A nozzle head in accordance with the present invention is identified as a whole with reference numeral 1. It has a stationary cylindrical housing 2 provided with a pressurized water connection 3. A hollow shaft 5 is rotatably supported in the housing and provided with a central passage 4. It is supported for this purpose on roller bearings 7, 8, 9 provided in an inner chamber 6 of the housing 2.

A sleeve 10 extends from the pressurized water connection 3. It passes through the central passage 4 of the hollow shaft 5 to a blind hole 11 in a nozzle carrier 12. The nozzle carrier 12 is connected with the hollow shaft 5.

The sleeve 10 is provided on its periphery with a plurality of circularly extending grooves 47 having a semi-circular cross-section and spaced from one another by a small distance. The grooves 47 form a part of labyrinth gap seal between the sleeve 10 and a limiting wall of the passage 4. The partial quantities of the pressurized medium which flows through the labyrinth seal are collected in a chamber 13 provided with radially outwardly extending discharge openings 14.

Figure 2:
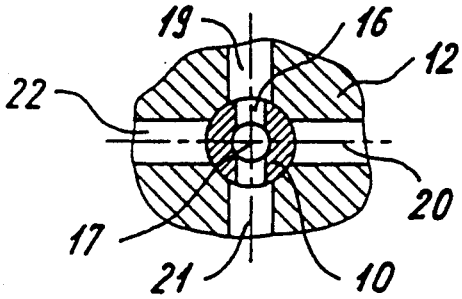
FIG. 2 is a view showing a section taken along the line II—II in FIG. 1, on an enlarged scale.

The free end 15 of the sleeve 10, which is located inside the blind hole 11 of the nozzle carrier 12 is closed. The sleeve 10 is provided with transverse openings 16 near the end 15. During the rotation of the nozzle carrier, pressurized water can flow through the transverse opening 16 into passages which are arranged in the nozzle carrier and lead to spraying nozzles 18. In the embodiment shown in FIGS. 1 and 2, the nozzle carrier 12 has four nozzles. Therefore, four passages 19, 20, 21, 22 are provided in the nozzle carrier, and two of the passages are loaded with pressurized water through the transverse opening 16.

The sleeve 10 in the shown embodiment has exclusively one transverse opening 16 which extends through the whole cross-section of the sleeve. The central axes of the passages 19, 20, 21, 22 intersect the central axis of the transverse opening 16 and the central axis of a supply conduit 17 in a single point. As can be seen from FIG. 2, the diameter of the transverse opening 16 is smaller than the inner diameter of the passages 19, 20, 21, 22 which lead to the injection nozzles 18.

A sleeve-shaped supporting body 23 is mounted on the housing 2. A copper ring 24 is fixed on the supporting body 23 and surrounds permanent magnets 25 with a distance therebetween. The permanent magnets 25 are mounted in a ring body 26. The permanent magnets and the copper ring form together an eddy current brake for braking the rotary movement of the nozzle carrier 12.

The working pressure of the pressurized water can amount to 1,000 bar and lies preferably in the pressure region between 1,000 and 3,000 bar. The nozzle head is surrounded by a hood 27 which is open to a surface to be cleaned.

Figure 3:
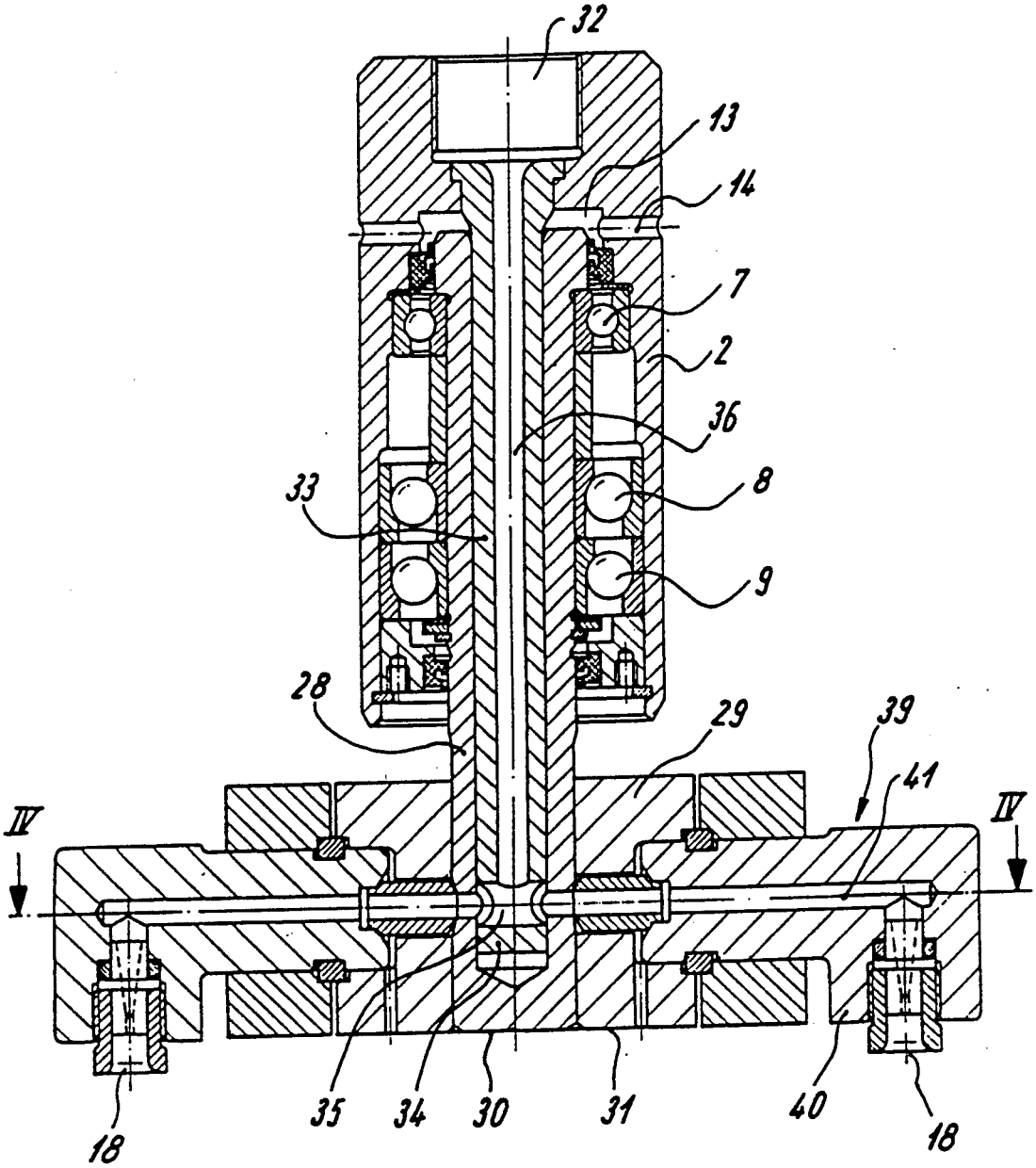
FIG. 3 is a view showing a nozzle head in accordance with a further embodiment of the invention, in a vertical section.
Figure 4:
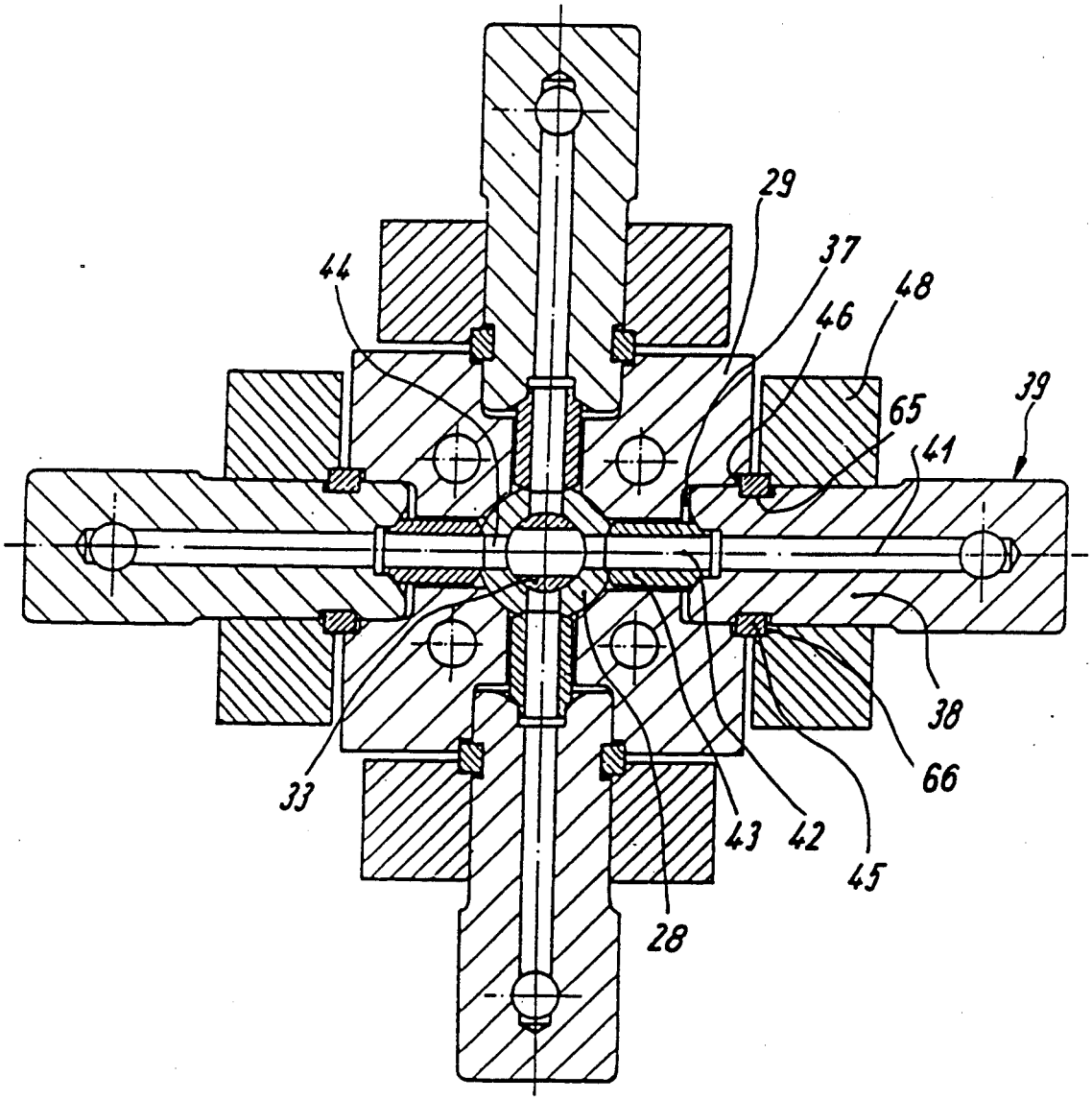
FIG. 4 is a view showing a section taken along the line IV—IV in FIG. 3.

In the embodiment shown in FIGS. 3 and 4 a hollow shaft 28 extends over the whole height of a nozzle carrier 29 which has a rectangular cross-section. A free end surface 30 of the hollow shaft is flush with a limiting surface 31 of the nozzle carrier 29. The hollow shaft and the nozzle carrier are welded with one another. A stationary sleeve 33 extends from a pressurized water connection 32 to the region of the nozzle carrier 29 and is enclosed by the hollow shaft over the whole length of the hollow shaft.

In this embodiment the sleeve 33 has a transverse opening 35 near its closed end 34. The transverse opening 35 extends over the whole cross-section of the sleeve. It passes a supply conduit 36 formed by the sleeve 33 and has a diameter which is greater than the inner diameter of the passages leading to the injection nozzles 18.

The multi-cornered nozzle carrier 29 is provided with cylindrical recesses 37. An end of a cylindrical pipe 38 of an angular piece 39 is inserted in a respective one of the recesses 37. Its vertical leg 40 carries the injection nozzle 18. The angular piece 39, provided with passages 41 for supplying pressurized water, can be rotated relative to the nozzle carrier in a stepless manner and arrested in any desired position. Thereby the injection nozzles 18 assume the inclined position which is required for driving the nozzle carrier together with the hollow shaft 28.

In the nozzle carrier 29, passages 42 for supplying pressurized water are limited by bushings 43. The bushings abut with their ends against the hollow shaft 28 and against the cylindrical pipes 38 of the angular piece 39. The passages 42 coincide with throughflow openings 44 arranged in the hollow shaft 28.

In the region of the connection between the nozzle carrier 29 and the cylindrical pipes 38 of the angular piece 39, each cylindrical pipe of the angular piece has an annular groove 65 which extends over the whole pipe periphery. A sealing and anchoring ring 45 is arranged in the annular groove 65. The anchoring ring 45 engages in an angular groove 46 of the nozzle carrier 29 and in an angular annular groove 66 of a mounting block 48. The mounting block surrounds a pipe 38 and is connected with the nozzle carrier. The connection can be performed by screws.

Figure 5:
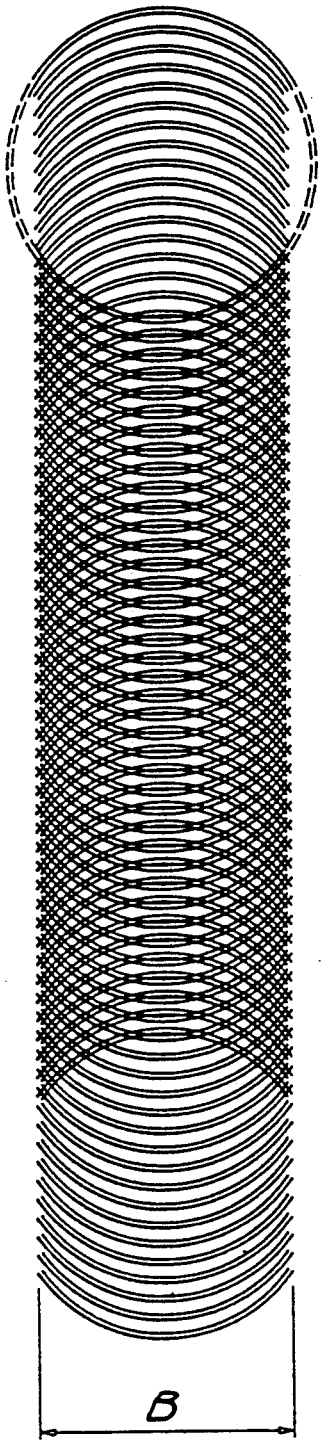
FIG. 5 is a view showing a track formed by the nozzle head of the invention and having a width B.
Figure 6:
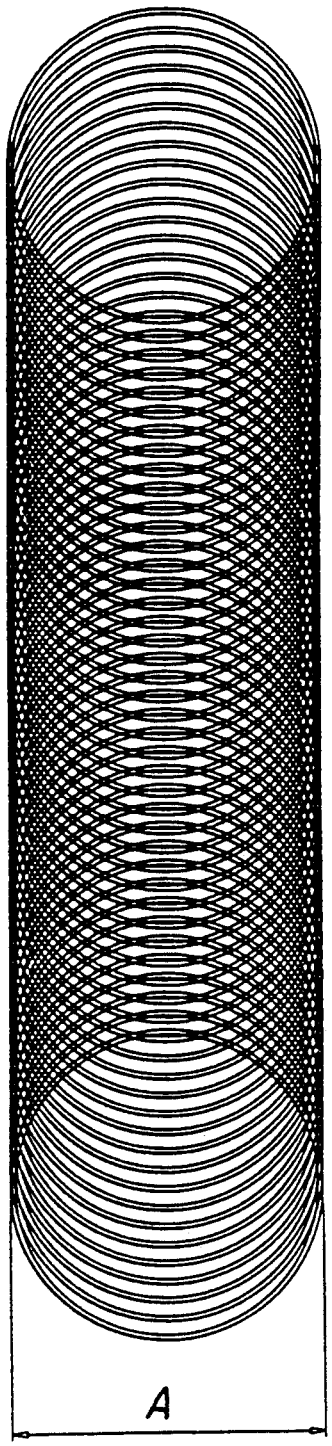
Fig. 6 PRIOR ART
FIG. 6 is a view showing a track with a width A formed by a known nozzle head and produced by the nozzles during the total circulation of the injection water.
Figure 7:
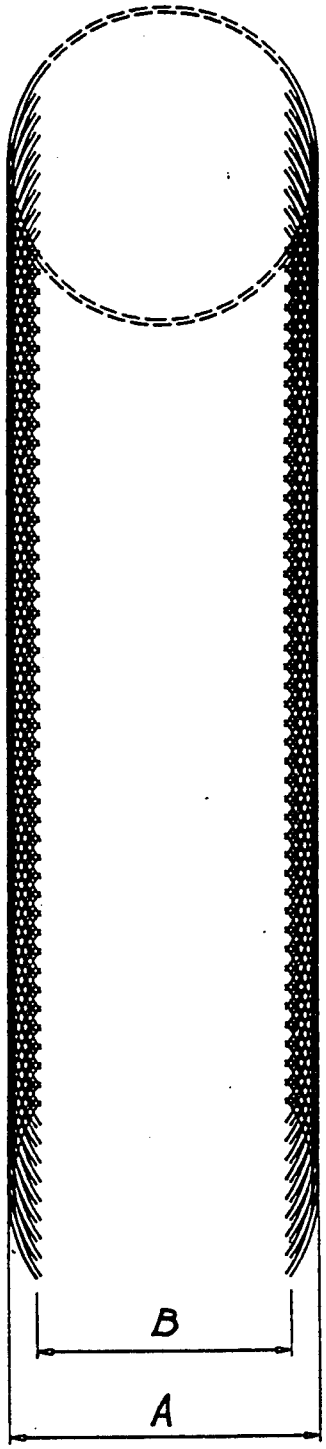
FIG. 7 is a view showing a difference between the track width A and B.

FIG. 5 shows a track with a width B which is covered by jets discharging from the rotatable injection nozzles to an object to be treated. FIG. 6 shows a track width A which is covered by a known tool, wherein the injection nozzles are operative without interruption, or in other words, over a rotation path of 360°. FIG. 7 shows the edge region which is produced by the difference A−B and is contributed to the present invention.

Figure 8:
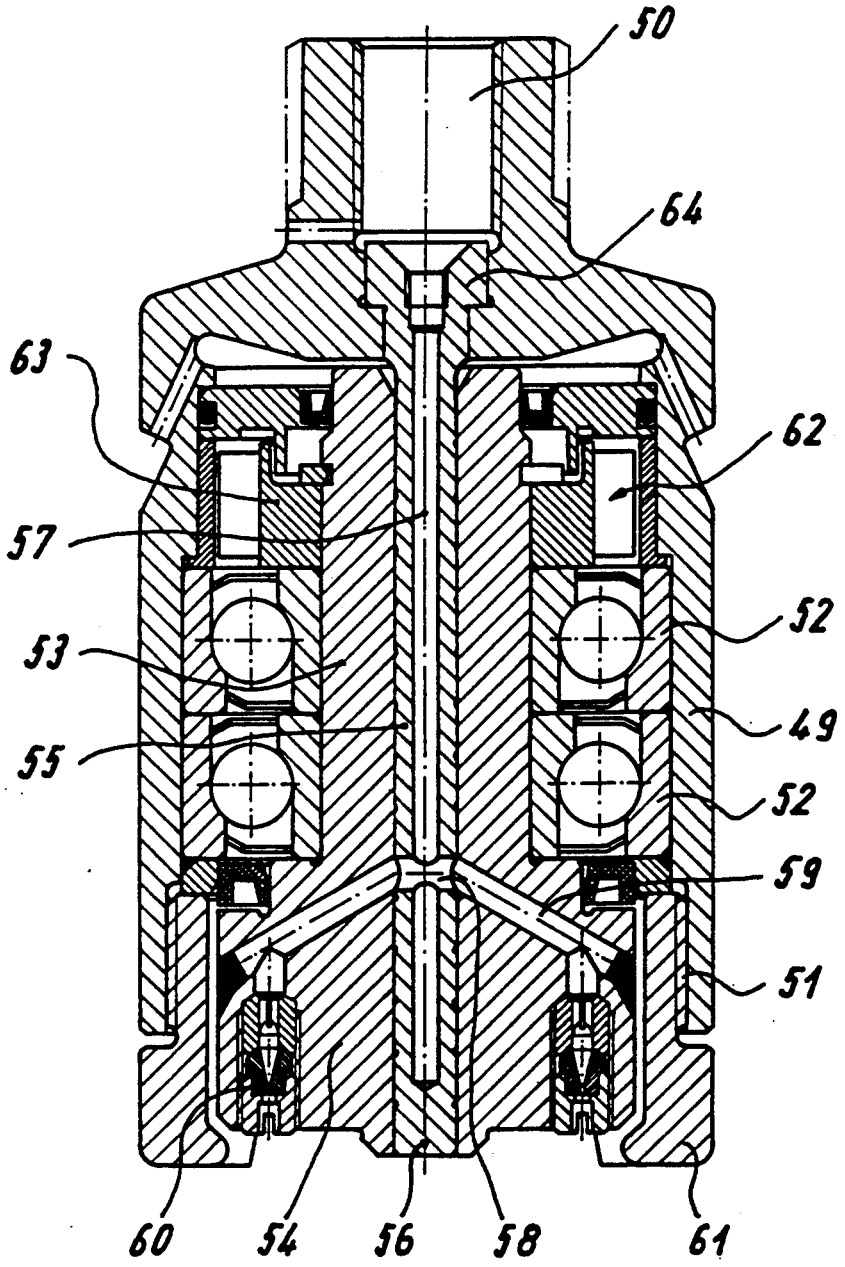
FIG. 8 is a view showing a nozzle in accordance with still a further embodiment of the present invention.

FIG. 8 shows a nozzle head with a very compact construction. This nozzle head is provided with a cylindrical housing body 49 having a pressurized water connection 50 at its rear end and an inner thread 51 at its front end. Roller bearings 52 rotatably support a hollow shaft 53 in the housing body 49. The hollow shaft 53 is a one-piece integral member with a nozzle carrier 54. A stationary sleeve 55 inserted in the housing extends over the whole length of the central passage of the hollow shaft. The sleeve 55 is closed at its free end 56 and forms a supply conduit 57 for a transverse opening 58 and for passages 59 which lead to nozzles 60. The transverse opening 58 is arranged at a significant distance from the end 56. Thereby the bearing conditions between the hollow shaft 53 and the sleeve 55 are improved. A protective ring 61 is screwed in the inner thread 51.

A brake device 62 is further provided in the housing. Its inner ring 63 is mounted on the hollow shaft 53. The sleeve has a headpiece 64 which is fixed on the housing body.

It will be understood that each of the elements described above, or two or more together, may also find a useful application in other types of constructions differing from the types described above.

While the invention has been illustrated and described as embodied in a nozzle head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A nozzle head, comprising a plurality of nozzles; a nozzle carrier rotatable about an axis and driveable by a reaction of a pressurized water discharged from said nozzles, said nozzle carrier has passages communicating with said nozzles; a housing having a pressurized water connection; and a stationary sleeve having at least one opening and formed so that during rotation of said nozzle carrier with said nozzles relative to said stationary sleeve, the water passing through said opening of said stationary sleeve is successively supplied to some of said nozzles and is not supplied to other of said nozzles so that a water supply on the way from said opening of said stationary sleeve to said rotatable nozzles produces water jets which cover a cylindrical surface concentric to said axis and also is interrupted in edge regions parallel to a displacement direction of the nozzle head relative to an object, said opening of said stationary sleeve and said passages of said nozzle carrier being arranged so that during rotation of said nozzle carrier with said nozzles, successively some of said passages of said nozzle carrier communicate with said opening of said stationary sleeve while other of said passages of said nozzle carrier do not communicate with said opening of said stationary sleeve, so that the water passing through said opening of said stationary sleeve is supplied to some of said nozzles and is not supplied to said other of said nozzles.

2. A nozzle head as defined in claim 1; and further comprising a hollow shaft extending through said housing and having a central passage, said sleeve extending through said central passage of said hollow shaft.

3. A nozzle head as defined in claim 2, wherein said nozzle carrier is multi-cornered and provided with cylindrical recesses; and further comprising an angular piece having a plurality of cylindrical pipes each having an end inserted in a respective one of said cylindrical recesses of said nozzle carrier, said angular piece having a plurality of vertical legs each carrying a respective one of said nozzles, said angular piece being provided with said passages extending from said opening to said nozzles, said angular piece being rotatable relative to said nozzle carrier in a stepless manner and arrestable relative to said nozzle carrier.

4. A nozzle head as defined in claim 3, wherein said angular piece is provided with an annular groove extending over its whole periphery in the region between said nozzle carrier and said cylindrical pipes of said angular piece; and further comprising a sealing and anchoring ring arranged in said annular groove.

5. A nozzle head as defined in claim 4, wherein said nozzle carrier has angular grooves; and further comprising a mounting block which surrounds said pipes and is connectable with said nozzle carrier, said sealing and anchoring ring extending in said angular grooves of said nozzle carrier and in said mounting block.

6. A nozzle head as defined in claim 3, wherein said nozzle carrier has an opening which extends over a whole height of said nozzle carrier and receives a free end of said hollow shaft, said hollow shaft being welded with said nozzle carrier.

7. A nozzle head as defined in claim 6, wherein said hollow shaft surrounds said sleeve over a full length of said hollow shaft.

8. A nozzle head as defined in claim 3; and further comprising a plurality of bushings each limiting a portion of a respective one of said passages communicating said opening with said nozzles, each of said bushings having opposite ends abutting against said hollow shaft and a respective one of said cylindrical pipes of said angular piece.

9. A nozzle head as defined in claim 2, wherein said housing has a housing body provided with a head piece, said central passage extending over a whole length of said hollow shaft and receives over its whole length said sleeve, said sleeve being fixed in said head piece.

10. A nozzle head as defined in claim 9, wherein said hollow shaft and said nozzle carrier are formed of one-piece integrally with one another.

11. A nozzle head as defined in claim 10, wherein said housing body has a free end; and further comprising a protective ring which surrounds said nozzle carrier and is arranged at said free end of said housing body.

12. A nozzle head as defined in claim 2; and further comprising means for sealing said sleeve relative to said central passage of said hollow shaft and including a plurality of ring grooves provided in said sleeve and forming a labyrinth seal.

13. A nozzle head as defined in claim 1; and further comprising means for braking rotation of said nozzle carrier.

14. A nozzle head as defined in claim 1, wherein said sleeve forms a supply conduit having a central axis, said sleeve having only one said opening which extends over a total cross-section of said sleeve, said passages communicating said opening with said nozzles and said passages having central axes which intersect with said central axis of said supply conduit in one point.

15. A nozzle head as defined in claim 1, wherein said passages extending from said opening to said nozzles have a predetermined inner diameter, said opening having a diameter which is smaller than the diameter of said passages.

16. A nozzle head as defined in claim 1, wherein said passages extending from said opening to said nozzles have a predetermined inner diameter, said opening having a diameter which is greater than the diameter of said passages.

17. A nozzle head as defined in claim 1, wherein said sleeve has a closed free end, said opening in said sleeve being arranged at a distance from said closed free end of said sleeve.

* * * * *